US007540578B2

(12) United States Patent
Suzuki et al.

(10) Patent No.: US 7,540,578 B2
(45) Date of Patent: Jun. 2, 2009

(54) INKJET RECORDING APPARATUS

(75) Inventors: Masao Suzuki, Tokyo (JP); Hitoshi Arai, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 279 days.

(21) Appl. No.: 11/477,917

(22) Filed: Jun. 30, 2006

(65) Prior Publication Data

US 2007/0008359 A1 Jan. 11, 2007

(30) Foreign Application Priority Data

Jul. 6, 2005 (JP) ..... 2005-197740

(51) Int. Cl.
*B41J 29/38* (2006.01)

(52) U.S. Cl. ..... 347/12; 347/13; 347/42

(58) Field of Classification Search ..... 347/12, 347/13, 42, 5, 9, 41, 43

See application file for complete search history.

(56) References Cited

U.S. PATENT DOCUMENTS 6,062,666 A * 5/2000 Omata et al. ..... 347/12
2005/0024420 A1 * 2/2005 Ebihara ..... 347/19

* cited by examiner

*Primary Examiner*—Lam S Nguyen
(74) *Attorney, Agent, or Firm*—Manabu Kanesaka

(57) ABSTRACT

An inkjet recording apparatus includes recording heads with nozzles selectively discharging ink and arranged at a predetermined pitch in a line. The recording heads are arranged in a zigzag fashion. Respective ends of two adjacent recording heads are overlapped with each other to form a joint part. Ink from selected nozzles of respective recording heads is discharged on print paper fed along a sub scanning direction at a predetermined timing corresponding to positions of the respective recording heads in the sub scanning direction such that an in-line image continuous in the main scanning direction is formed on the print paper. The inkjet recording apparatus further includes a control unit for controlling a driving operation of the respective nozzles at the joint part depending upon a dispositional relation between the nozzles of two recording heads at the joint part in the main scanning direction.

4 Claims, 8 Drawing Sheets

View illustrating structure of line head

One color line head is constructed with plural modules.

Plan view of printing paper surface

Printing pixel overlap parts are constructed between modules
= joint parts

Normally, approximately ten pixels are overlapped with each other.

View illustrating image formation of line head (a) Printing (protrusion) of preceding modules is performed in paper feeding direction.

(b) Printing (protrusion) of following modules is performed at the time when paper is fed by a pitch between modules (in sub scanning direction).

(c) A line image is apparently formed on paper.

In the case of no joint correction

Enlarged view of joint part

View illustrating occurrence state of assembly error

Embodiment of joint correction pattern

Selected depending on occurrence state of assembly error.

(a) No joint correction (b) Joint correction = A pattern (c) Joint correction = B pattern Joint correction according to embodiment of present invention

INKJET RECORDING APPARATUS

BACKGROUND OF THE INVENTION

1. Field of the Invention

The present invention relates to an inkjet recording apparatus including plural recording heads, each of which has plural nozzles arranged at a predetermined pitch in a line, wherein the plural recording heads are arranged in a zigzag fashion such that the recording heads are parallel with a main scanning direction while ends of the recording heads are overlapped with each other, and the nozzles of the respective recording heads are driven at a predetermined timing corresponding to the positions of the respective recording heads in a sub scanning direction such that ink is discharged on print paper fed along the sub scanning direction, thereby forming an arbitrary image including an in-line image. More particularly, the present invention relates to an inkjet recording apparatus constructed such that the quality of an obtained image is not deteriorated at positions corresponding to joint parts of the recording heads (overlap parts of the nozzle arrays) of the above-described inkjet recording apparatus even when assembly error of nozzle pitch occurs at the joint parts.

2. Description of the Related Art

It is economically unreasonable that a head of an inkjet recording apparatus, which discharges ink from nozzles to form an image, is constructed as a unitary structure having a length corresponding to the width of print paper. Consequently, small-sized recording heads are normally modularized, and plural modularized recording heads are assembled to construct a large-sized line head having a desired length.

For example, Patent Reference 1 discloses an inkjet printing apparatus including plural inkjet heads, each of which has plural ink nozzles for discharging ink, wherein the ink nozzles are arranged at a predetermined interval in a line, and the inkjet heads are arranged such that the arranging directions of the ink nozzles coincide with each other in a line. The distance between the adjacent inkjet heads may be greater or less than the nozzle pitch of each inkjet head depending upon the assembly accuracy of the inkjet heads. In this case, however, portions of an image corresponding to joint parts of the inkjet heads are merely thickened or thinned by increasing or decreasing the number of ink drops, and therefore, lines or spots are formed in the obtained image. In the inkjet printing apparatus disclosed in Patent Reference 1, the number of ink drops are not merely increased or decreased depending upon the nozzle pitch at the joint parts of the inkjet heads, but the number of ink drops is decided such that ink can be appropriately spread around the joint parts with a statistically desired concentration by a fuzzy control, without fixing the number of ink drops. As a result, a regular shape does not appear at positions of the image formed on print paper, which correspond to the joint parts of the inkjet heads, and therefore, lines or spots are not visible.

[Patent Reference 1] Japanese Unexamined Patent Publication No. 2005-7582

In the case that a large-sized inkjet recording apparatus is constructed by assembling plural small-sized recording heads, which are modularized, in parallel with each other, when the nozzle pitch of the respective recording heads, each of which is constructed as a module, is small, the pitch between the nozzles at the coupling parts of the adjacent recording heads may not be physically maintained. In this case, it is impossible to combine the plural recording heads such that the recording heads are arranged in a line; however, it is possible to two-dimensionally arrange the recording heads in a zigzag fashion such that the nozzle arrays of the respective recording heads are parallel with a main scanning direction, whereby the nozzle arrays at the corresponding ends of the adjacent recording heads are overlapped with each other.

FIG. 1 is a view schematically illustrating the structure of the above-described inkjet recording apparatus. Plural small-sized recording heads 1, which are modularized, are prepared, and the modularized recording heads 1 are arranged side by side in a zigzag fashion along a main scanning direction (in the right-and-left direction in the drawing). In the illustrated example, the inkjet recording apparatus is a single color (for example, black color) inkjet recording apparatus. Approximately 10 of nozzles are overlapped at the joint part 2 (the overlap part of the nozzle arrays) between the adjacent recording heads 1 (modules). Approximately five of the nozzles, among approximately ten of the nozzles, which are overlapped at the joint part 2, are continuous with the nozzles, which are not overlapped, of one of the adjacent recording heads 1, and therefore, approximately five of the front nozzles, which are arranged before the above-mentioned nozzles, are not used. Approximately five of the remaining nozzles, among approximately ten of the nozzles, which are overlapped at the joint part 2, are continuous with the nozzles, which are not overlapped, of the other of the adjacent recording heads 1, and therefore, approximately five of the front nozzles, which are arranged before the above-mentioned nozzles, are not used. Consequently, the distance between the nozzles, which are used, at the ends of the respective recording heads 1 becomes equal to the distance between the nozzles of the recording heads 1.

In the inkjet recording apparatus in which the plural modularized recording heads 1 are arranged in a zigzag fashion along the main scanning direction as described above, print paper 3 is fed in the sub scanning direction (in the upward-and-downward direction in FIG. 1), ink is discharged from the respective nozzles selected from the respective recording heads 1 to the print paper 3 at a predetermined timing corresponding to the positions of the respective recording heads in the sub scanning direction, whereby an in-line image continuous in the main scanning direction is formed on the print paper 3, which will be described below in detail.

First, as shown in FIG. 2A, ink is discharged (printing is performed) from recording heads 1*a*, which are located at the front part in the sub scanning direction (in the paper feeding direction). Subsequently, as shown in FIG. 2B, ink is discharged from recording heads 1*b*, which are located at the rear part in the sub scanning direction, at the time when the print paper 3 has been fed by the separation distance of the recording heads 1 in the sub scanning direction from the state shown in FIG. 2A. As a result, as shown in FIG. 2C, an in-line image continuous in the main scanning direction, is formed on the print paper 3.

In the case that the plural recording heads 1 are arranged such that the recording heads 1 are overlapped with each other at the joint parts in the main scanning direction, however, it is necessary that the plural recording heads 1 be arranged in a two-dimensional plane in a zigzag fashion along the main scanning direction as described above. Especially, it is necessary that the respective recording heads 1 be arranged and assembled with high accuracy such that the nozzle pitch between the adjacent recording heads 1 at the joint part 2 is equal to the pitch of the respective recording heads 1.

Furthermore, a step may occur between the recording heads 1 and 1 even in the sub scanning direction depending upon the accuracy of the disposition of the recording heads 1 and the accuracy of the feeding of the paper. The following description will be given in consideration of the fact that misalignment occurs at the joint part 2 in the sub scanning direction.

FIGS. 3A to 3C are enlarged views illustrating images entirely printed on the print paper 3 by the inkjet recording apparatus shown in FIG. 1. In the drawings, the circles indicate dots formed on the print paper 3 by ink drops discharged from one nozzle. Dots formed by one of the recording heads are indicated in outline, and dots formed by the other recording head are indicated in light black. In FIGS. 3A to 3C, nine enlarged images are shown by the combination of assembly error states and misalignments in the sub scanning direction (the middle parts have no misalignment, and the upper and lower parts have misalignments in opposite directions).

When the assembly error in the main scanning direction at the joint part 2 of the above-mentioned adjacent recording heads 1 is 0, as shown in FIG. 3A, the deterioration of the quality of the image at the position corresponding to the middle joint part 2 does not occur even though the misalignment occurs in the sub scanning direction. However, when the distance between the nozzles in the main scanning direction at the joint part 2 of the adjacent recording heads 1 is decreased, as shown in FIG. 3B, the concentration of the overlapped portions of the dots becomes thick, and therefore, a black straight line is formed in the sub scanning direction. Also, when the distance between the nozzles in the main scanning direction at the joint part 2 of the adjacent recording heads 1 is increased, as shown in FIG. 3C, the concentration of the separated portions of the dots does not appear, and therefore, a white straight line is formed in the sub scanning direction. These are important factors that are visibly prominent, and therefore, deteriorate the quality of the image, which are necessary to be improved.

A method of adjusting the assembly error to "0" may be embodied by providing a structure in which the positions of the respective recording heads 1 constituting the line head can be adjusted, and performing the adjustment during the assembly process. However, it is necessary that the plural recording heads 1 be arranged in a zigzag fashion, in two dimensions, and with high accuracy, as described above. For this reason, the adjustment costs are greatly increased.

Consequently, the adjustment is actually carried out with appropriate accuracy.

SUMMARY OF THE INVENTION

Therefore, the present invention has been made in view of the above problems, and it is an object of the present invention to provide an inkjet recording apparatus including plural recording heads 1, which are arranged in a zigzag fashion such that the recording heads 1 are parallel with a main scanning direction while adjacent ends of the recording heads are overlapped with each other, and the nozzles of which are driven at a predetermined timing corresponding to the positions of the respective recording heads 1 in a sub scanning direction such that ink is discharged on print paper 3 fed along the sub scanning direction, and therefore, an arbitrary image is formed on the print paper, wherein the quality of an image is not deteriorated, at positions on the print paper 3 corresponding to joint parts 2 of the recording heads 1 (overlap parts of the nozzle arrays), by appropriately controlling the discharge of ink from the nozzles even when plus or minus assembly error of nozzle pitch occurs at the joint parts.

In accordance with one aspect of the present invention, the above and other objects can be accomplished by the provision of an inkjet recording apparatus including plural recording heads 1, each of which has plural nozzles, which selectively discharge ink, arranged at a predetermined pitch in a line, the inkjet recording apparatus being constructed such that the plural recording heads 1 are arranged in a zigzag fashion such that a disposition direction of the nozzles is parallel with a main scanning direction, the respective ends of two adjacent recording heads 1 are overlapped with each other to form a joint part 2, and ink from the selected nozzles of the respective recording heads 1 is discharged on print paper 3 fed along a sub scanning direction at a predetermined timing corresponding to positions of the respective recording heads in the sub scanning direction such that an in-line image continuous in the main scanning direction is formed on the print paper 3, wherein the inkjet recording apparatus further includes: a control unit for controlling the driving operation of the respective nozzles at the joint part 2 depending upon a dispositional relation between the nozzles of the two recording heads 1 at the joint part 2 in the main scanning direction.

When a distance in the main scanning direction at the joint part 2 between two nozzles located at endmost parts of the two recording heads 1, among the nozzles that are to be selected, is less than the predetermined pitch, an amount of ink less than a normal amount of ink is discharged from the two nozzles.

When the distance in the main scanning direction at the joint part 2 between two nozzles located at the endmost parts of the two recording heads 1, among the nozzles that are to be selected, is greater than the predetermined pitch, the amount of ink equal to the normal amount of ink is discharged from the two nozzles, and one nozzle of each recording head 1 disposed between the two nozzles in the main scanning direction is driven such that the amount of ink less than the normal amount of ink is discharged from the driven nozzles.

The inkjet recording apparatus further includes: a memory for storing data on the dispositional relation at the joint part 2 and positional data of the joint part 2, the memory being provided at the recording heads 1.

In accordance with another aspect of the present invention, there is provided a color inkjet recording apparatus for discharging different color inks to a common print paper, using the plural above-described inkjet recording apparatuses, which discharge the different color inks, respectively, to form a full color image on the common print paper 3, wherein the plural inkjet recording apparatuses are arranged such that the positions of the joint parts 2 are different from each other in the main scanning direction.

BRIEF DESCRIPTION OF THE DRAWINGS

The above and other objects, features and other advantages of the present invention will be more clearly understood from the following detailed description taken in conjunction with the accompanying drawings, wherein.

DESCRIPTION OF THE PREFERRED EMBODIMENTS

Now, preferred embodiments of the present invention will be described in detail with reference to the accompanying drawings, i.e., FIGS. 1 to 8.

(1) First Embodiment

FIGS. 1 to 6

Figure 1:
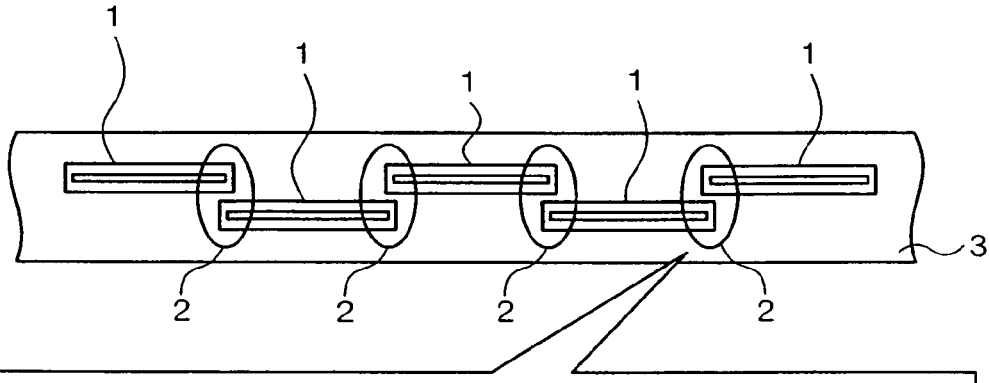
FIG. 1 is a typical plan view illustrating the fundamental structure of a line head of an inkjet recording apparatus according to a first embodiment of the present invention.
Figure 2:
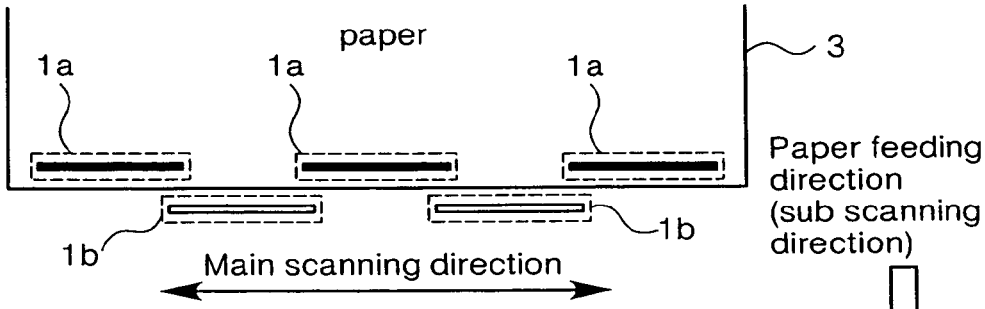
FIGS. 2A to 2C are views illustrating the formation of an image performed by the line head shown in FIG. 1.
Figure 2:
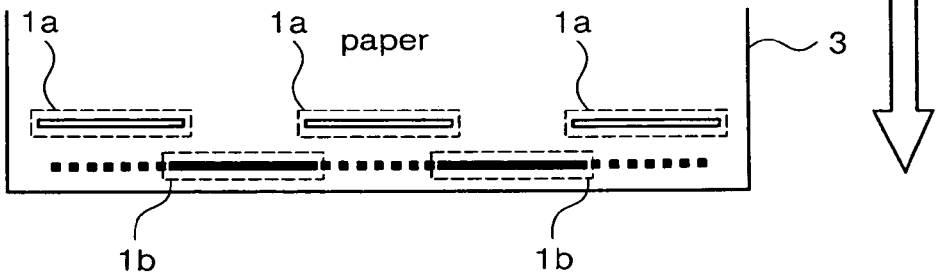
Figure 2:
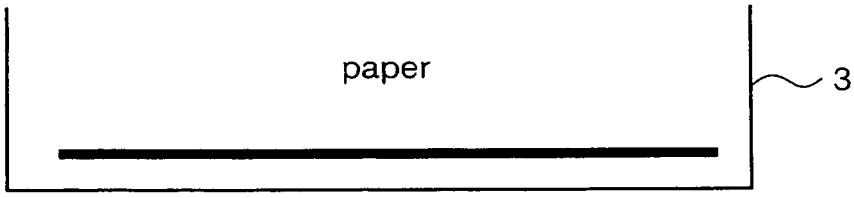
Figure 3:
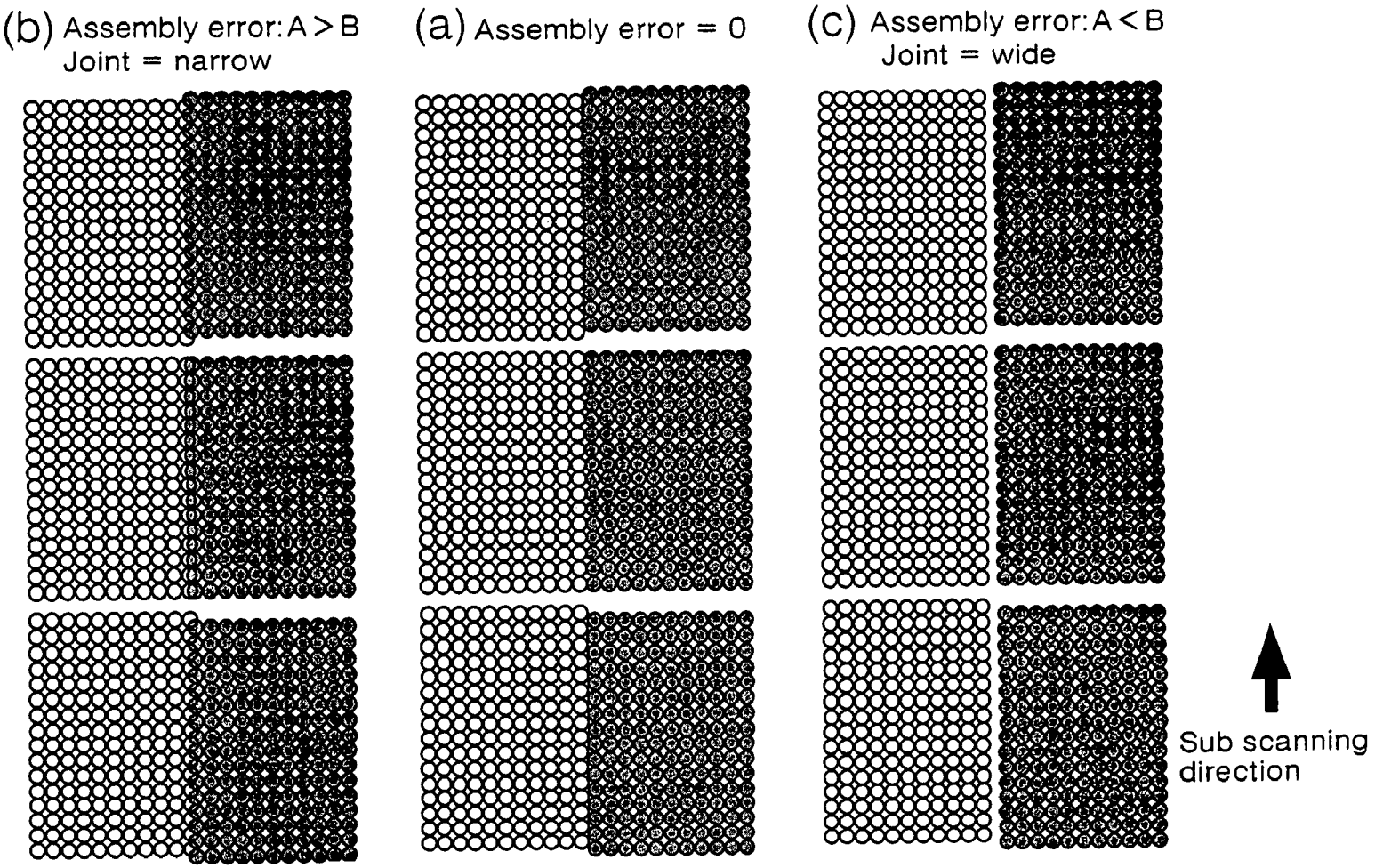
FIGS. 3A to 3C are views illustrating the results of the formation of images performed by the line head shown in FIG. 1 in the case that joint correction has not been carried out.
Figure 4:
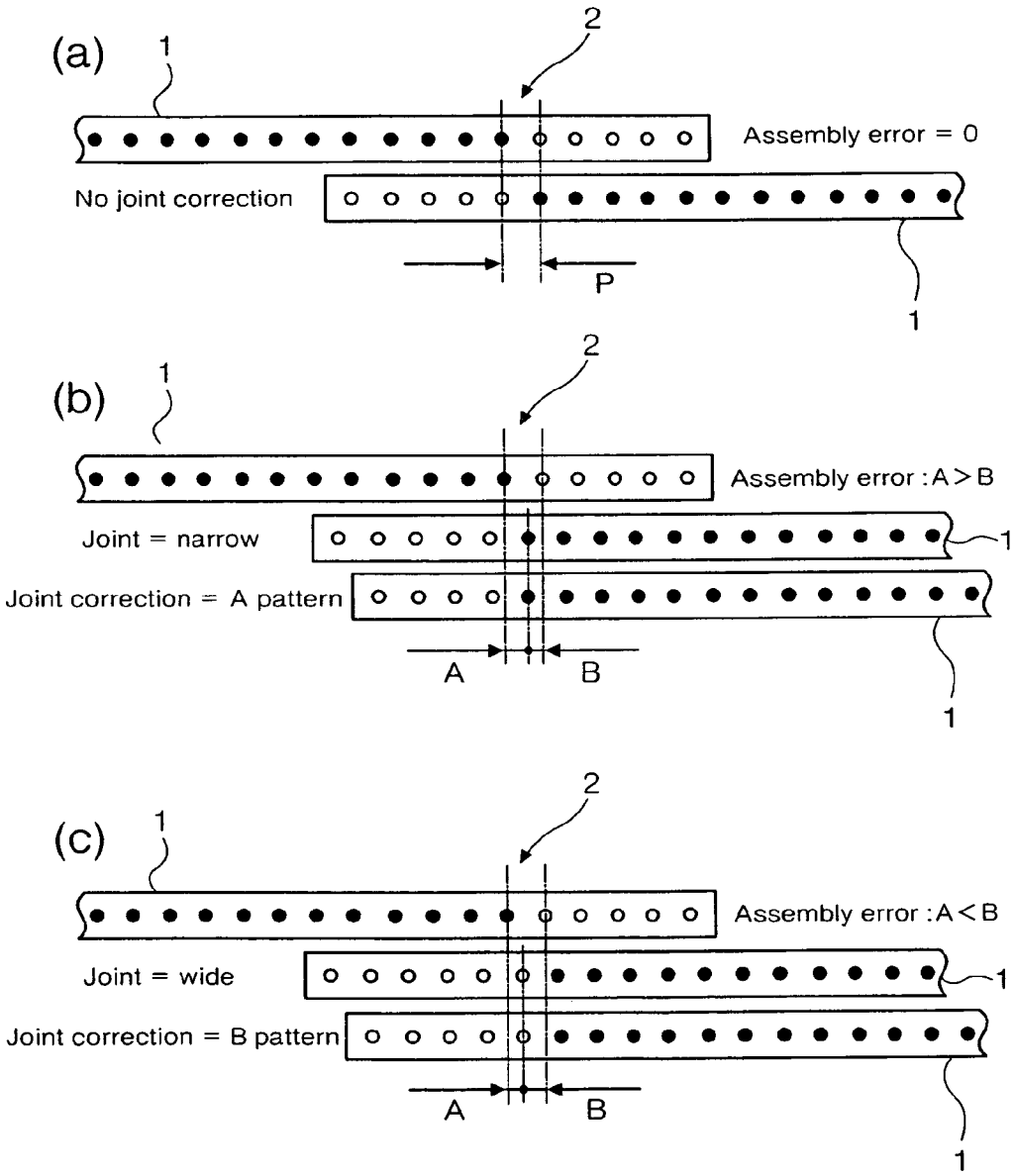
FIGS. 4A to 4C are enlarged views of a joint part of the line head shown in FIG. 1.
Figure 5:
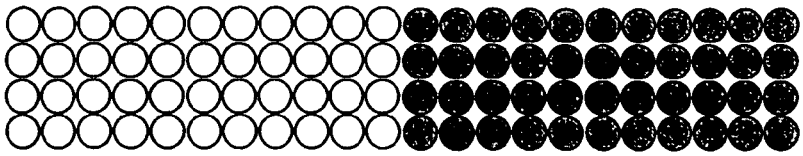
FIGS. 5A to 5C are views illustrating a method of correcting the joint part of the line head shown in FIG. 1.
Figure 5:
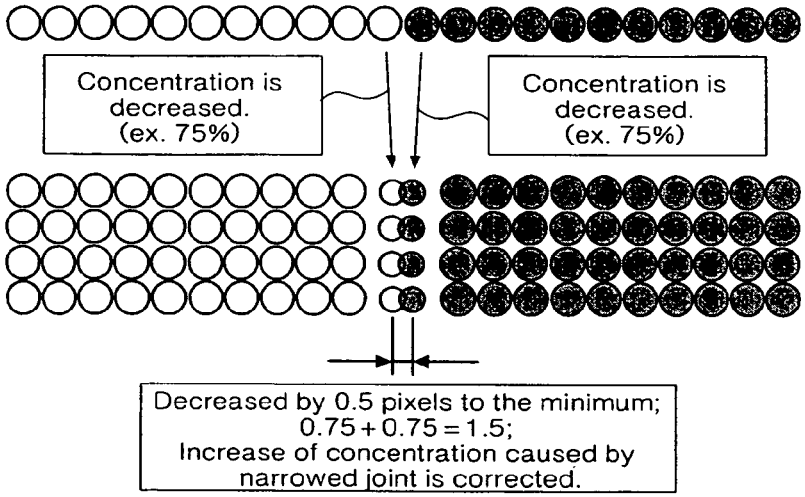
Figure 5:
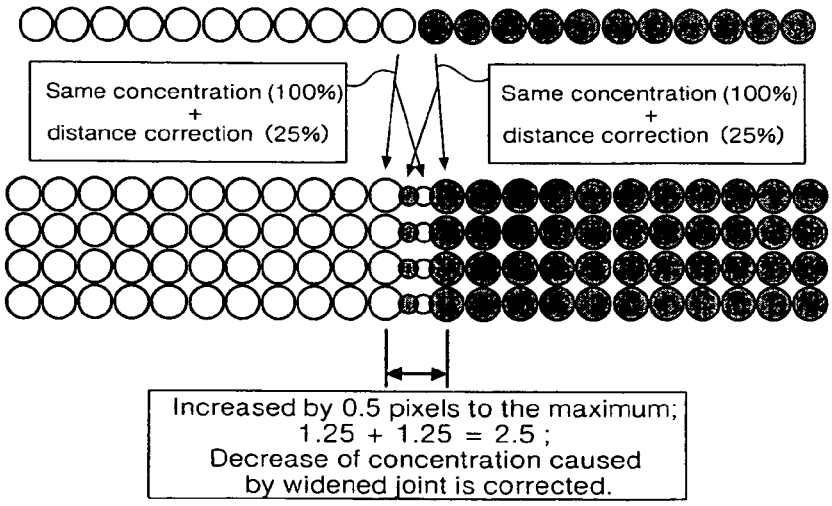

The inkjet recording apparatus according to this embodiment has a line head constructed in the same fundamental structure as that previously described with reference to FIG. 1. Specifically, the line head of the inkjet recording apparatus includes plural recording heads 1, each of which has plural nozzles, which selectively discharge ink, arranged at a predetermined pitch in a line, wherein the plural recording heads 1 are arranged in a zigzag fashion such that the arrangement direction of the nozzles is parallel with a main scanning direction, and the corresponding ends of two adjacent recording heads 1 and 1, which are adjacent to each other in the zigzag fashion, are overlapped with each other in the main scanning direction such that a joint part 2 is formed at the corresponding ends of the two adjacent recording heads 1 and 1, whereby the line head has a predetermined length in the main scanning direction (the lateral direction of print paper 3). Also, the print paper 3 is fed along the sub scanning direction by a paper feeding unit (not shown), and the respective recording heads of the line head are driven such that the driving operation of the recording heads is synchronous with the feeding operation of the paper, whereby ink is discharged from the selected nozzles at a predetermined timing corresponding to positions of the respective recording heads 1 in the sub scanning direction, and therefore, an arbitrary image, including an in-line image continuous in the main scanning direction, is formed on the surface of the print paper 3.

Figure 8:
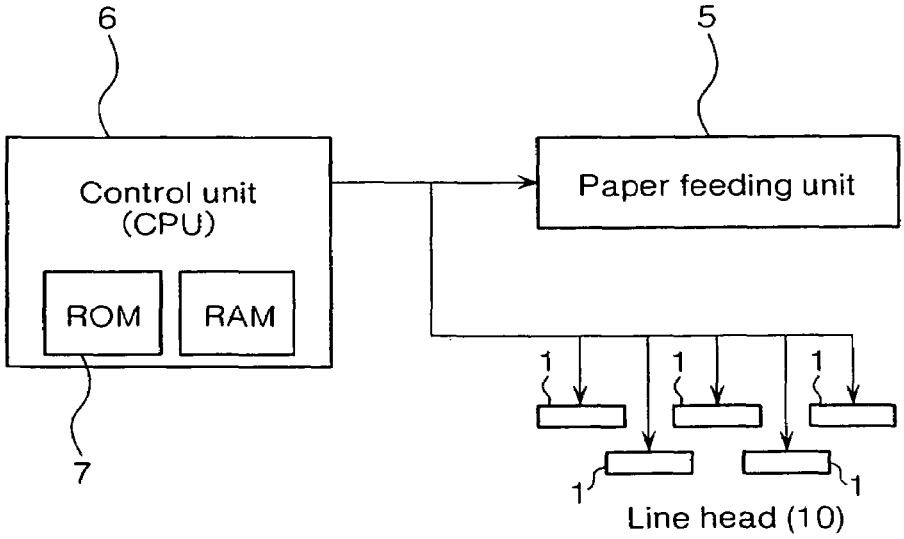
FIG. 8 is a block diagram typically illustrating an example of a control system of the inkjet recording apparatus according to the present invention.

As shown in FIG. 8, the line head 10, which includes the plural recording heads 1, and the paper feeding unit 5 are controlled by a control unit 6 (CPU) such that the operation of the recording heads 1 is synchronous with the operation of the paper feeding unit 5. Programs for controlling the feeding operation of the print paper 3 and the driving operation of the line head 10 are contained in a read-only memory (ROM) 7 of the control unit 6. Also, correction driving data inherent in the line head 10 is contained in the ROM 7 of the control unit 6. The correcting driving data is set depending upon the assembly accuracy or the nozzle pitch at the several joint parts 2 of the line head 10, which includes the plural recording heads 1 arranged in the zigzag fashion such that the recording heads 1 are overlapped with each other as in this embodiment. The correcting driving data is used to correct the amount of ink discharged from the nozzles of the joint parts 2 such that the printing quality on the positions of the print paper 3 corresponding to the joint parts is not deteriorated. That is, the line head 10 of the inkjet recording apparatus according to this embodiment has the plural recording heads 1, which are arranged in the zigzag fashion, and the joint parts 2 are located between the adjacent recording heads 1. However, the correction driving data inherent in the respective joint parts 2 is provided.

In this embodiment, the correction driving data is prepared as follows, and is stored into the ROM 7 of the control unit 6. First, after the line head 10 is assembled, the assembled line head 10 is mounted to a printing part of the inkjet recording apparatus, and a printing operation is performed with respect to the print paper 3 by discharging ink to the print paper 3 while the print paper 3 is fed, whereby an image is formed on the print paper 3. Subsequently, the quality of the obtained image is analyzed to confirm the assembly accuracy of the respective joint parts 2 of the line head 10 (the dispositional relation between the nozzles of the two recording heads 1 at the corresponding joint part 2). Specifically, as previously described with reference to FIGS. 3A to 3C, any one of the state that the assembly error has not occurred at the respective joint parts as shown in FIG. 3A, the state that the distance between the dots is narrow at the respective joint parts as shown in FIG. 3B, and the state that the distance between the dots is wide at the respective joint parts as shown in FIG. 3C appears on the print paper 3. Consequently, it is possible that the state of the respective joint parts 2 is determined, the correction driving data of the nozzles, which decides the amount of ink discharged, which is suitable to the determined state, is chosen, and the chosen correction driving data is stored in the ROM 7, for example, in a table-type structure in response to the respective joint parts 2.

FIGS. 4A to 4C are enlarged views illustrating the occurrence of assembly errors at the respective joint parts 2 of the line head 10 of the inkjet recording apparatus according to this embodiment. When the driving data is not corrected, the printing results as shown in FIGS. 3A to 3C are obtained by the arrangement of the nozzles. When the driving data is corrected as needed as will be described below, on the other hand, the printing is performed as typically illustrated in FIGS. 5A to 5C, which will be described below, and the image to be printed is corrected in response to the assembly errors, whereby the printing results respectively shown in FIGS. 6A to 6C are obtained, which will be described below.

Figure 6:
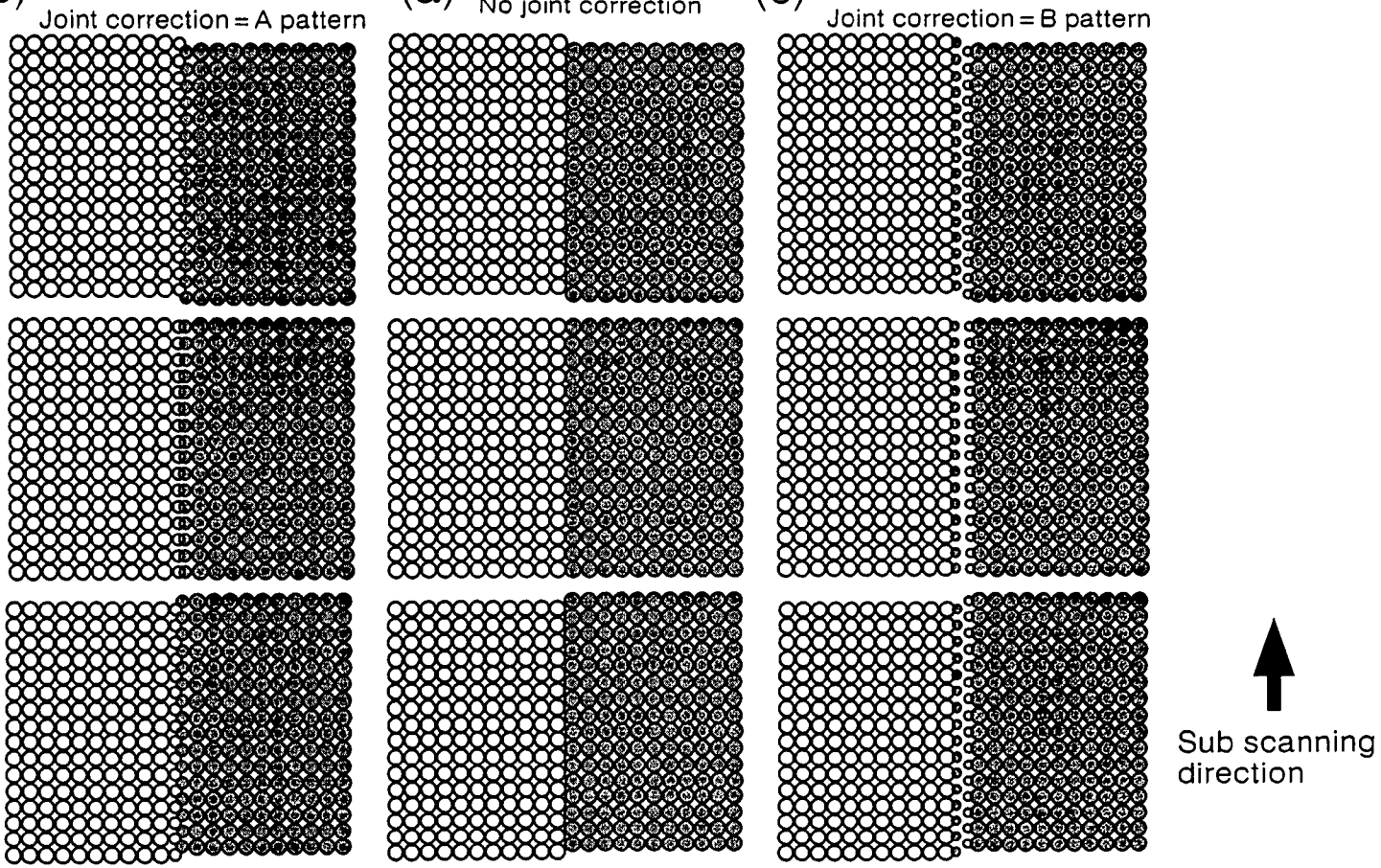
FIGS. 6A to 6C are views illustrating the results of the formation of images performed by the line head shown in FIG. 1 in the case that joint correction has been carried out.

Also, FIGS. 4B and 4C illustrate two cases that the overlapped states at one of the two recording heads 1 overlapped with each other at the joint part 2 (the lower parts of the drawings) are different by one nozzle pitch from each other. FIG. 6 illustrates the state of dots constituting an image in the same manner as FIG. 3.

First, when the distance P in the main scanning direction at the joint part 2 between one nozzle located at the endmost part of one of the recording heads 1 and one nozzle located at the endmost part of the other recording head 1, among the nozzles (shown in black circles) that are to be selected and driven, is equal to the nozzle pitch of the respective recording heads 1, as shown in FIG. 4A, the assembly error does not occur at the respective joint parts 2 of the line head 10. In this case, when the printing is performed on the entire surface of the print paper 3, the result as shown in FIG. 3A is obtained, and therefore, a significant difference is not generated, at least, in the main scanning direction, and a line does not appear in the sub scanning direction. Consequently, in this case, the correction of the driving data of the nozzles of the joint part 2 is not necessary.

When this printing result is enlarged and shown in the shape of dots, as shown in FIG. 5A, the respective dots are regularly arranged in a predetermine pitch. However, the difference in the sub scanning direction is not shown in FIG.

5A. Even when the image is shown in the state that the difference in the sub scanning direction occurs, a line, which deteriorates the quality of the image, does not appear on the image as shown in FIG. 6A.

Next, it is assumed that the distance in the main scanning direction at the joint part 2 between one nozzle located at the endmost part of one of the recording heads 1 and one nozzle located at the endmost part of the other recording head 1, among the nozzles (shown in black circles) that are to be selected and driven, is A, as shown in FIG. 4B. Also, it is assumed that the distance between the nozzle located at the end of one of the recording heads 1 (the nozzle located at the end of the lower recording head 1 in the drawing) and the unselected nozzle adjacent to the nozzle located at the end of the other recording head 1 is B, as shown in FIG. 4B. When A>B, the assembly error occurs in a state that the joint part 2 is narrow. In this case, when the printing is performed on the entire surface of the print paper 3 without correcting the driving data, the result as shown in FIG. 3B is obtained, and therefore, a black line appears at the position of the print paper 3 corresponding to the joint part 2 along the sub scanning direction. Consequently, it is necessary to correct the driving data of the nozzle of the joint part 2, which will be described below.

As shown in FIG. 5B, distance between two dots, which belong to the respective recording heads, and formed by the nozzles located at the adjacent two ends at the joint part 2, among plural dots (pixels) formed by two recording heads 1 and 1, which are expected to be arranged at a predetermined pitch in a line along the main scanning direction, becomes less than the predetermined pitch under the above-mentioned condition, i.e., under the condition of A>B, and therefore, the distance between the above-mentioned two dots is decreased by half of the predetermined pitch to the minimum. When the normal amount of ink is discharged in this state, two dots having a normal size are overlapped with each other on the print paper 3. As a result, a black line occurs as described above. Consequently, in this case, the inkjet recording apparatus is driven using the correction driving data to reduce the amount of ink discharged from the two nozzles located at the endmost parts of the recording heads corresponding to the two dots to 75% of the normal amount of ink. Specifically, the distance between the two dots is decreased by 0.5 pitch to the minimum, and therefore, the distance between the dots is decreased such that the sum of the amounts of ink for the two dots is 1.5 (0.75+0.75=1.5), whereby the increase of concentration caused by the decrease of the distance between the dots is corrected.

When the printing result obtained through the driving operation using the correction driving data is enlarged and shown in the shape of dots, as shown in the lower part of FIG. 5B, two dots corresponding to the joint part 2 are overlapped with each other in the case that no difference occurs in the sub scanning direction. However, these two dots are smaller than the other dots, and therefore, the quality of the image is not generally deteriorated at the position of the print paper corresponding to the joint part 2. Even when the image is shown in the state that the difference in the sub scanning direction occurs, a line, which deteriorates the quality of the image, does not appear on the image as shown in FIG. 6B.

Next, the case shown in FIG. 4C illustrates that any one of one nozzle located at the endmost part of one of the recording heads 1 and one nozzle located at the endmost part of the other recording head 1, among the nozzles (shown in black circles) that are to be selected and driven, at the joint part 2 (the nozzle located at the end of the lower recording head 1 in the drawing), is displaced in the direction in which one nozzle is spaced further apart from the other nozzle along the main scanning direction than the unselected nozzle adjacent to the nozzle located at the end of the other recording head 1. Here, it is assumed that the distance in the main scanning direction between the unselected nozzle adjacent to the nozzle located at the end of one of the recording heads 1 and the nozzle of the other recording head 1 is A. Also, it is assumed that the distance between the unselected nozzle adjacent to the nozzle located at the end of one of the recording heads 1 and the unselected nozzle adjacent to the nozzle located at the end of the other recording head 1 is B. When A<B, the assembly error occurs in a state that the joint part 2 is wide. In this case, when the printing is performed on the entire surface of the print paper 3 without correcting the driving data, the result as shown in FIG. 3C is obtained, and therefore, a white line appears at the position of the print paper 3 corresponding to the joint part 2 along the sub scanning direction. Consequently, it is necessary to correct the driving data of the nozzle of the joint part 2, which will be described below.

As shown in FIG. 5C, the distance between two dots, which belong to the respective recording heads, and formed by the nozzles located at the adjacent two ends at the joint part 2, among plural dots (pixels) formed by two recording heads 1 and 1, which are expected to be arranged at a predetermined pitch in a line along the main scanning direction, becomes greater than the predetermined pitch under the above-mentioned condition, i.e., under the condition of A<B, and therefore, the distance between the above-mentioned two dots is increased by half of the predetermined pitch to the maximum. When the normal amount of ink is discharged in this state, two dots are normally printed on the print paper 3. However, the distance between the two dots is excessively wide. As a result, a white line occurs as described above. Consequently, in this case, the inkjet recording apparatus is driven using the correction driving data to maintain the amount of ink discharged from the nozzles located at the two ends of the recording heads corresponding to the two dots to the normal amount of ink, and to drive the unselected nozzles adjacent to the nozzles located at the two ends such that 25% of the normal amount of ink can be discharged from the unselected nozzles. Specifically, the distance between the two dots is increased by 0.5 pitch to the maximum. Consequently, the amount of ink for the two dots is not changed, and the two additional dots located in the widened part are formed by a small amount of ink, such that the sum of the amounts of ink for the two dots is 2.5 (1.25+1.25=2.5), whereby the decrease of concentration caused by the increase of the distance between the dots is corrected.

When the printing result obtained through the driving operation using the correction driving data is enlarged and shown in the shape of dots, as shown in the lower part of FIG. 5C, two dots corresponding to the joint part 2 are formed while being spaced a distance greater than the predetermined pitch from each other in the case that no difference occurs in the sub scanning direction. However, the two dots, which are formed using 25% of the amount of ink (concentration), are added in the widened part to correct the distance, and therefore, the quality of the image is not generally deteriorated at the position of the print paper corresponding to the joint part 2. Even when the image is shown in the state that the difference in the sub scanning direction occurs, a line, which deteriorates the quality of the image, does not appear on the image as shown in FIG. 6C.

(2) Second Embodiment

FIG. 7

Figure 7:
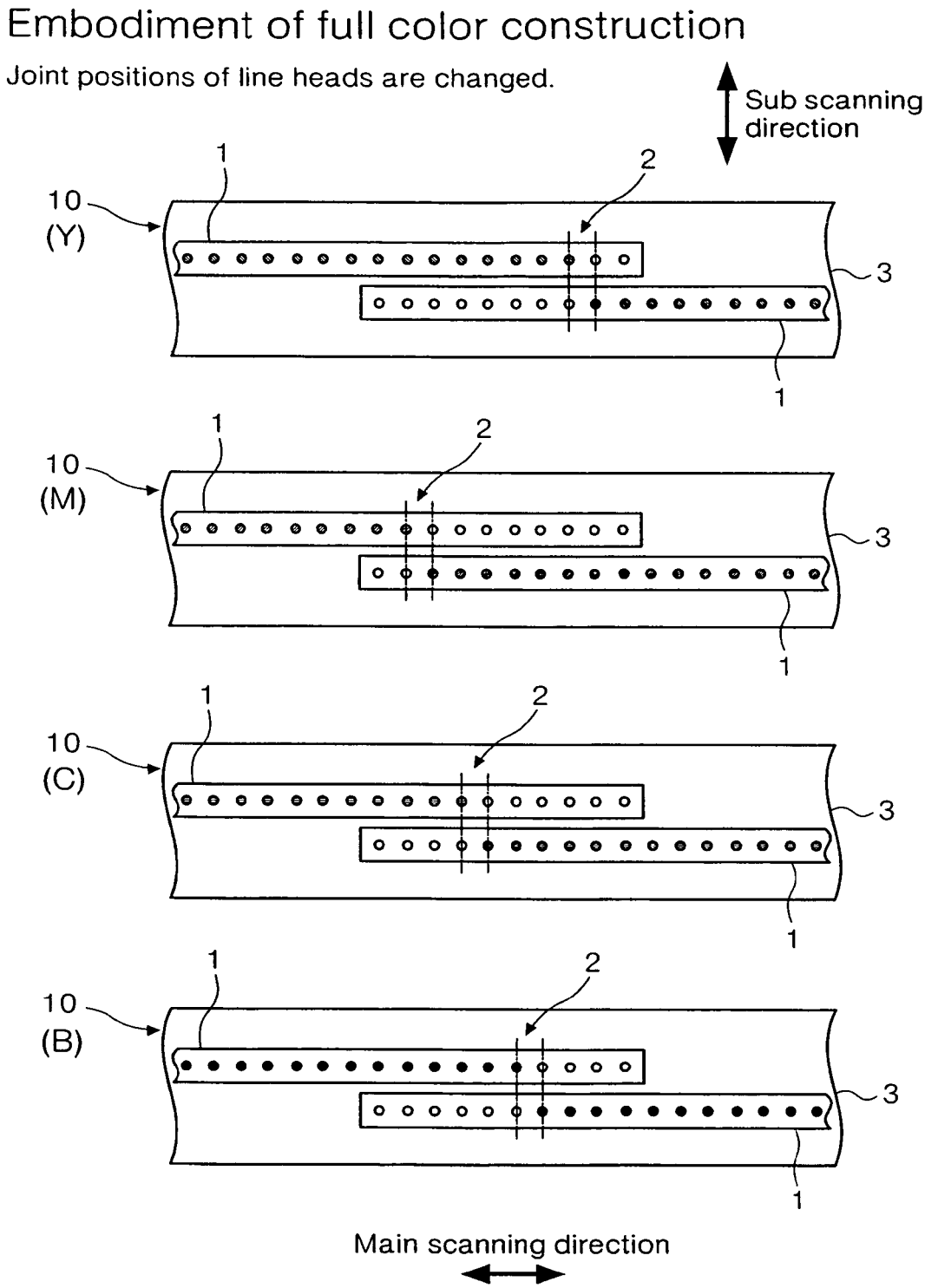
FIG. 7 is a typical plan view illustrating the fundamental structure of a line head of an inkjet recording apparatus according to a second embodiment of the present invention.

As shown in FIG. 7, the inkjet recording apparatus according to this embodiment includes four line heads 10, one of which has been previously described in connection with the first embodiment of the present invention. The respective line heads 10 are constructed such that different color inks can be discharged from the respective line heads 10. In this embodiment, four color inks include cyan C, magenta M, yellow Y, and blue B, which are printed on print paper while being overlapped with each other, whereby a full color image is formed on the print paper.

The respective line heads 10 are arranged along the feeding route of a common printing paper 3 such that main scanning directions are parallel with each other while the respective line heads 10 are spaced a predetermined interval in the feeding direction of the print paper 3 (in a sub scanning direction). Also, the respective line heads 10 are constructed such that the positions of the joint parts 2 are different from each other in a main manipulating direction. Specifically, as shown in FIG. 7, the overlapped parts of the recording heads 1 of the respective line head 10 are the same, but pluralities (in this embodiment, 10 for each recording head 1) of nozzles included in the overlapped parts correspond to the adjacent recording heads 1 in different manners.

This embodiment includes the same control unit as shown in FIG. 8. The four line heads 10 are controlled by the control unit at an appropriate timing such that the operation of the line heads 10 are synchronous with the feeding operation of the print paper 3. The driving data, which drives the respective line heads 10, is image data for the respective colors corresponding to the respective ink colors obtained through the color separation of the full color image. In the same manner as in the first embodiment, the correction is performed based upon the correction driving data inherent in the joint parts 2 of the respective line heads 10.

Consequently, according to this embodiment, when the full color image is formed, the deterioration of the quality of the image at the joint parts 2 of the respective line heads 10 is low. Furthermore, the joint parts 2 of the respective line heads 10 are not overlapped with each other in the sub scanning direction. As a result, influence due to the joint parts of the respective line heads 10 becomes further insignificant, and therefore, it is possible to obtain a good-quality full color image.

According to the present invention, the number of the nozzles, to which the correction of the driving operation is actually performed, in the joint part 2 of the two recording heads 1 arranged adjacent to each other in the zigzag fashion is small, for example, at most approximately two. Consequently, when approximately 10 of the nozzles are overlapped with each other at the joint part 2, the positions of the nozzles, to which the correction of the driving operation is performed, among them, can be set in the main scanning direction with considerably high freedom, and therefore, it is possible to change the joint position in the color inkjet apparatus that discharges the plural color inks from the plural line heads 10 as in this embodiment.

In the above-described embodiments, the joint state of the respective line heads 10 is detected through a test printing, correction driving data inherent in the respective line heads 10 is obtained based on the detected joint state, and the obtained correction driving data is stored in the memory of the control unit 6. However, this information may be provided at the line heads 10 side such that the information can be read out by the control unit 6 side at any time, and the read-out information can be used to perform the controlling operation. Specifically, it is possible that data on the dispositional relation between the nozzles at the joint part 2 of the line head 10 and positional data of the corresponding joint part 2 are stored in the memory, the memory is provided at the recording heads 1, the control unit 6 reads out data from the memory of the line head 10, the driving data is corrected by the read-out data, and then the printing operation is performed.

Although the joint state of the respective line heads 10 is detected through the test printing in the above-described embodiments, it is also possible that the joint part 2 of the line head 10 is directly observed, using a microscope, to detect the joint state of the nozzles.

As apparent from the above description, the present invention has the following effects.

In the case that the positional difference, which deteriorates the quality of the image, occurs at the joint part 2 due to the assembly of the recording heads 1 when the inkjet recording apparatus according to the present invention is manufactured, it is confirmed, by performing a test printing on the print paper 3, whether the positional difference is caused due to the increase or the decrease of the nozzle pitch, and the driving state (the amount of ink discharged) of the respective recording heads 1 is set by the control unit of the inkjet recording apparatus based on the confirmation.

Specifically, when the positional difference is less than the nozzle pitch at the joint part 2, the respective nozzles of the adjacent two recording heads 1 arranged in a small pitch in the main scanning direction at the joint part 2 are driven such that the amount of ink less than the amount of ink discharged from the nozzles arranged in the regular pitch is discharged from the nozzles of the adjacent two recording heads 1 arranged in the small pitch, whereby the driving information of the corresponding nozzles, which is stored in the control unit, is set. When the above-mentioned correction is applied to the control of the ink discharge by the control unit, the pitch between the two dots corresponding to the joint part 2 is small, during the printing operation of the inkjet recording apparatus, as compared to the pitch between the regular dots arranged on the print paper 3 in the main scanning direction. As a result, the concentration is increased, and therefore, a black line is formed on the print paper 3 corresponding to the joint part 2 in the sub scanning direction. According to the present invention, however, the diameter of dots formed by the ink drops is decreased at the joint part 2 having the decreased pitch, and therefore, the concentration is decreased. Consequently, no black line is formed on the print paper 3 corresponding to the joint part 2 along the sub scanning direction.

Also, when the positional difference is greater than the nozzle pitch at the joint part 2, the respective nozzles of the adjacent two recording heads 1 arranged in a large pitch in the main scanning direction at the joint part 2 are driven such that the same amount of ink as the amount of ink discharged from the nozzles arranged in the regular pitch is discharged from the nozzles of the adjacent two recording heads 1 arranged in the small pitch. In addition to this, one nozzle belonging to each recording head 1 and arranged inside each of the above-mentioned nozzles having the positional difference is added as a nozzle to be driven, and the added nozzles are driven such that the amount of ink less than the amount of ink discharged from the nozzles arranged in the regular pitch is discharged from the nozzles of the added nozzles. Driving information to drive the respective nozzles of the recording heads 1 as described above is stored in the memory of the control unit. When the above-mentioned correction is applied to the control of the ink discharge by the control unit, the pitch between the two dots corresponding to the joint part 2 is large, during the printing operation of the inkjet recording apparatus, as compared to the pitch between the regular dots arranged on the print paper 3 in the main scanning direction. As a result, the representation of the concentration is not possible, and therefore, a white line is formed on the print paper 3 corresponding to the joint part 2 in the sub scanning direction.

According to the present invention, however, the dots having a small dot diameter are additionally formed at the joint part 2 having the increased pitch, and therefore, the appropriate concentration is represented at the white part on the print paper 3. Consequently, no white line is formed on the print paper 3 corresponding to the joint part 2 along the sub scanning direction.

As described above, the inkjet recording apparatus according to the present invention has the plural joint parts between the recording heads 1 and 1. However, the state of the nozzle pitch is confirmed for the respective joint parts 2, and control information corresponding to the positions and states of the joint parts 2 is stored in the memory of the control unit. Consequently, even though the assembly accuracy of the recording heads 1 is lowered, any defect caused due to the nonuniformity of the nozzle pitch does not occur on a image, and therefore, it is possible to obtain a quality image. In other words, it is unnecessary to perform the arrangement and alignment of the recording heads 1 with high costs and high accuracy when the inkjet recording apparatus is assembled. Also, even when the assembly error occurs, it is unnecessary to perform the adjustment with high costs. According to the present invention, it is possible to obtain a quality image by assembling the recording heads with allowable costs and appropriate accuracy and storing the driving correction control data corresponding to the assembly state and the assembly accuracy in the control unit.

Also, in the inkjet recording apparatus according to the present invention, data on the dispositional relation between the nozzles at the respective joint parts 2 is previously stored in the memory, and the memory is provided at the corresponding joint part 2. Consequently, when the inkjet recording apparatus is connected to a control apparatus, the above-mentioned data stored in the memory is automatically transmitted to the control unit such that the data can be used to perform the control operation, and therefore, it is possible to perform the correction control of the ink discharge depending upon the assembly states of the joint parts 2.

Furthermore, in the case that plural inkjet recording apparatuses, which are provided for plural different colors, are prepared to construct a full color printing apparatus, the plural inkjet recording apparatuses are arranged such that the positions of the joint parts 2 are different from each other in the main manipulating direction, whereby influence of the respective colors of the full color image on the joint parts 2 is decreased, and therefore, it is possible to provide an image having a natural quality in appearance.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An inkjet recording apparatus, comprising:

a plurality of recording heads, each of the recording heads having a plurality of nozzles selectively discharging ink and arranged at a predetermined pitch in a line, the plurality of recording heads being arranged in a zigzag fashion such that a disposition direction of the nozzles is parallel with a main scanning direction, respective ends of two adjacent recording heads being overlapped with each other to form a joint part, and ink being discharged from selected nozzles of the respective recording heads on print paper fed along a sub scanning direction at a predetermined timing corresponding to positions of the respective recording heads in the sub scanning direction for forming an in-line image continuous in the main scanning direction on the print paper, each of the two adjacent recording heads including expected ink discharging nozzles located in a middle portion of the recording head and having an end nozzle located at an end of the expected ink discharging nozzles, said end nozzle in one recording head of the two adjacent recording heads and said end nozzle in the other recording head being arranged to have a distance the same as the predetermined pitch in the main scanning direction so as to form the joint part in the in-line image, and each of the two adjacent recording heads further including at least one endmost nozzle adjacent to said end nozzle on a side opposite to the expected ink discharging nozzles, and a control unit for controlling a driving operation of the respective nozzles at the joint part depending upon a dispositional relation between the two end nozzles of the two adjacent recording heads at the joint part in the main scanning direction, wherein when the distance between the two end nozzles of the two adjacent recording heads is greater than the predetermined pitch, said expected ink discharging nozzles discharge an amount of ink equal to a normal amount of ink, and each of the at least one endmost nozzle discharges an amount of ink less than the normal amount of ink, and wherein when the distance between the two end nozzles of the two adjacent recording heads is the predetermined pitch, each of the at least one endmost nozzle does not discharge the ink.

2. The inkjet recording apparatus according to claim 1, further comprising a memory for storing data on the dispositional relation at the joint part and positional data of the joint part, the memory being provided at the recording heads.

3. A color inkjet recording apparatus for discharging different color inks to common print paper, comprising a plurality of inkjet recording apparatuses according to claim 1, each of said inkjet recording apparatuses discharging different color ink, respectively, to form a full color image on the common print paper, wherein the plurality of inkjet recording apparatuses is arranged such that positions of joint parts are different from each other in the main scanning direction.

4. The inkjet recording apparatus according to claim 1, wherein the at least one endmost nozzle in the recording head includes a plurality of nozzles, in which one nozzle adjacent to the end nozzle discharges the amount of ink less than the normal amount of ink when the distance between the two end nozzles of the two adjacent recording heads is greater than the predetermined pitch.

* * * * *